United States Patent [19]

Gage

[11] 4,168,666

[45] Sep. 25, 1979

[54] RAILWAY TRUCK FLOATING PEDESTAL LINER

[75] Inventor: Paul E. Gage, Wyomissing, Pa.

[73] Assignee: The Polymer Corporation, Reading, Pa.

[21] Appl. No.: 912,872

[22] Filed: Jun. 5, 1978

Related U.S. Application Data

[63] Continuation-in-part of Ser. No. 708,661, Jul. 26, 1976, Pat. No. 4,094,253.

[51] Int. Cl.[2] ..... B61F 5/30; B61F 5/50; B61F 17/36; F16C 33/20

[52] U.S. Cl. ..... 105/225; 105/221 R; 308/238

[58] Field of Search ..... 105/221 R, 225; 308/238

[56] References Cited

U.S. PATENT DOCUMENTS

| | | | |
|---|---|---|---|
| 1,866,264 | 7/1932 | Melcher | 105/225 X |
| 1,903,859 | 4/1933 | Glascodine | 105/225 |
| 2,474,008 | 6/1949 | Meyer | 105/225 |
| 3,378,317 | 4/1968 | Fisher et al. | 105/225 X |
| 3,554,618 | 1/1971 | Ditzler et al. | 105/225 X |
| 4,001,124 | 1/1977 | Hussey | 105/225 X |
| 4,094,253 | 6/1978 | Gage | 105/225 |

*Primary Examiner*—Trygve M. Blix
*Assistant Examiner*—Howard Beltran
*Attorney, Agent, or Firm*—Richard O. Church

[57] ABSTRACT

A floating pedestal liner for railroad trucks and a method for its mounting are disclosed in which the liner is restricted from moving in a vertical direction but is free to move in a horizontal plane either laterally or longitudinally.

3 Claims, 4 Drawing Figures

FIG. 1
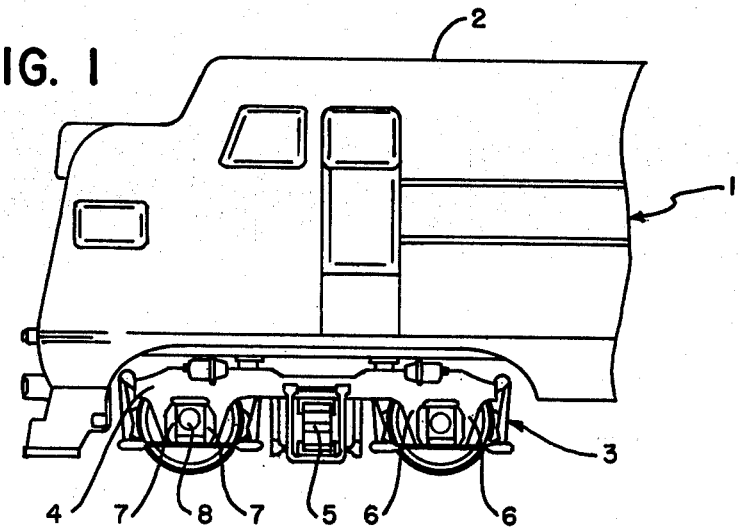
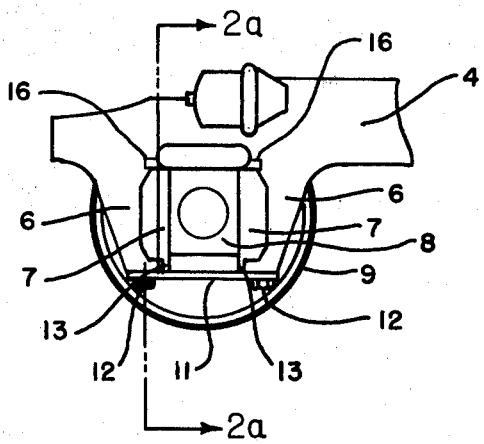
FIG. 2
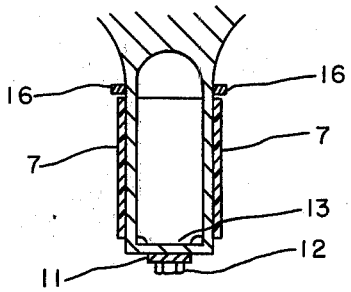
FIG. 2a
FIG. 3
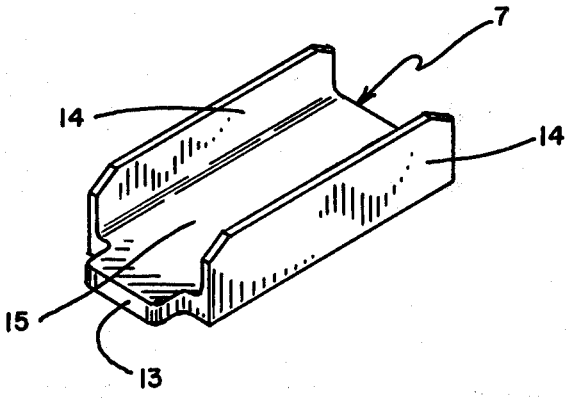

RAILWAY TRUCK FLOATING PEDESTAL LINER

HISTORY OF THE APPLICATION

This application is a continuation in part of copending application Ser. No. 708,661 filed July 26, 1976, now U.S. Pat. No. 4,094,253, issued June 13, 1978.

BACKGROUND OF THE INVENTION

1. Field of the Invention

This invention relates to improvements in trucks for railroad locomotives and cars and, more particularly, to improved pedestal liners that form bearing surfaces for those portions of the trucks that are slidably engaged to accommodate relative movement, in a generally vertical direction, between the wheels and body of the locomotive car. More particularly, this invention relates to pedestal liners of the "floating" type in which the liners are not secured to the pedestals, but instead, are free to move in relationship to the pedestal leg.

2. Description of the Prior Art

The truck upon which a railroad locomotive or car body is supported is comprised essentially of two side frames tied together by a transverse piece called the "bolster." One type of truck commonly used for locomotives is referred to as a "pedestal truck." The pedestals are part of the side frames and are formed in inverted "U"-shaped sections that horizontally position and hold the journal box while permitting the journal box to move essentially vertically in relationship to the truck. The two projections that comprise the "U" of the pedestal are called the "pedestal legs" and the space between them the "jaw." The jaw is closed at the bottom when the journal box is inserted by means of a pedestal tie bar. In this arrangement, the journal box is held positioned in vertical sliding relationship with the truck and, since the locomotive body is supported by the bolster and side frames, vertical movement between the locomotive body and the journal box, journal and wheels is permitted.

As considerable wear takes place at the engaging faces of the pedestal and the journal box, it is common practice to attach wear plates to both the pedestal legs and the journal boxes. The former are referred to as "pedestal liners" and the latter as "journal box wear plates." Conventionally, the journal box wear plate is attached to the journal box by welding, whereas the pedestal liner is removably mounted as by bolting onto the pedestal legs.

Until recent years, the wear plates conventionally have been manufactured of hardened high-carbon spring steel or other alloy steel such as manganese steel. More recently, however, it has been found that improved performance can be obtained by utilizing wear plates made from some of the tougher plastics such as nylons, polyacetals, polyurethanes, polyolefins, polycarbonates, polyesters, rigid polyvinyls, polyethers, polysulfones, polyimides, polyamidimides, polysilcones, and the like. As is disclosed in U.S. Pat. No. 3,554,618, these plastic materials may be used to form a generally "U"-shaped wear plate that can be bolted onto the pedestal leg of a railroad truck.

Plastic pedestal liners particularly those made of nylon, have gained wide acceptance throughout the industry primarily due to the fact that they do not crack as frequently and so outwear alloy steel liners. Plastic liners are also advantageous in that they reduce the wear on mating surfaces such as the pedestal legs and the journal box and therefore reduce repair and maintenance of the railroad trucks.

While plastic pedestal liners have, by and large, proven considerably more satisfactory in use than the steel alloy liners, they do sometimes fail by cracking adjacent to those areas where they are bolted onto the pedestal. It is believed that under conditions of heavy use, the plastic liners can fracture due to the fatigue stress acting on liners through the point where they are secured to the pedestal leg. This stress cracking may become particularly pronounced under extremely cold winter conditions.

It has been conventional to bolt the pedestal liner to the pedestal leg and, indeed, it has always been thought necessary to do so, particularly with respect to steel pedestal liners. If the steel liners are not fastened to the pedestal leg, either by bolting or by welding, they may severely wear the mating cast steel pedestal legs, which then have to be rebuilt or replaced; they may hang up, resulting in damage both to the liners and the mating parts; they will pound against and cause fatigue to the journal boxes; and they cause excessive noise from metal surfaces impacting against each other.

In my copending patent application Ser. No. 708,661 filed on July 26, 1976, it is disclosed that, quite surprisingly, plastic pedestal liners do not have to be secured to the pedestal legs but may be permitted to "float'-'—i.e., move relative both to the journal box and the pedestal leg. By these means, the liners are not subject to the same fatigue stress and breakage as are other pedestal liners that are bolted on to the pedestal leg.

While plastic floating pedestal liners have proven quite satisfactory, unrestricted vertical movement of the liner may, under certain circumstances, cause damage to the liner and more than normal wear to the pedestal leg. First, if the pedestal liner is not restricted in vertical movement, it may work its way upwardly along the pedestal leg into a position where it can be severely impacted by the spring seat when the railroad car or locomotive goes over a bump in the rails. Second, rapid vertical movement of the pedestal liner, as sometimes experienced with high speed trains, may cause some wear to the surfaces of the pedestal leg.

SUMMARY OF THE INVENTION

Accordingly it is the object of this invention to provide a method for mounting pedestal liners in a manner which will restrict the vertical movement of the liner but, at the same time, permit the liner to move horizontally both in a longitudinal and lateral direction.

Briefly the object of this invention is achieved by installing, as by welding, a stop on an upper portion of the pedestal leg that will restrict the movement of the pedestal liner in a vertical direction while not confining the liner from horizontal movement.

The invention may more readily be understood in accordance with the accompanied drawings in which:

FIG. 1 is a somewhat schematic representation of a side view of a portion of a railroad locomotive;

FIG. 2 is an enlarged view, partially broken away, of the side frame of a pedestal truck illustrating a pedestal liner mounted in accordance with this invention; and FIG. 2*a* is a sectional view taken along line 2*a*—2*a* of FIG. 2.

FIG. 3 is a perspective view of a pedestal liner adapted for use with this invention.

In FIG. 1 there is generally shown a portion of the front end of a railroad locomotive 1. Essentially, the locomotive is comprised of a car body or cab 2 supported on a truck generally shown at 3. The mounting of the locomotive cab 2 on the truck 3 includes springs 5 mounted in the side frame 4 of the truck. As can best been seen with reference to FIG. 2, the truck 3 is of the pedestal type—that is, the side frame 4 carries a pedestal defined by the depending pedestal legs 6. Mounted directly upon the pedestal legs 6 are pedestal liners 7. The pedestal liners 7 define the inside surfaces of the jaws of the side frame 4, which jaws are adapted to receive in vertical sliding relationship the journal box 8 which in turn serves as a bearing for the axle (not shown) that secures the wheels 9 for rotation.

The pedestal liner 7 is shown in FIG. 3 as having a generally "U"-shaped configuration with a base 15 and two side walls 14. Depending from one end of the base 15 is a land 13. The pedestal liner 7 is installed on the pedestal leg 6 as shown in FIG. 2 with the land 13 in the downward position. The pedestal liners 7 are secured in position by means of the tie bar 11 that closes the jaws of side frame 4 when the tie bar 11 is bolted in position by fasteners 12. Thus, it can be seen that the liner 7 is supported at its base by tie bar 11 and is held vertically positioned by the journal box 8 on the one side and the pedestal leg 6 on the other side.

Metal stops 16 are mounted at an upper portion of the pedestal legs 6 to limit the vertical movement of the pedestal liners 7. These metal stops can conveniently be installed as by welding and are positioned to limit the upward vertical movement of the liners 7. By these means the liners 7 remain free to move in a horizontal plane, both longitudinally and laterally but are restricted from moving upwardly on the pedestal leg.

I claim:

1. In a pedestal truck for railroad locomotives including:

a pair of spaced-apart, vertically-disposed pedestal legs that define a jaw open at its lower end;

a journal box mounted within the jaw in vertical sliding relationship to the pedestal legs;

a pedestal tie bar extending between the ends of the pedestal legs closing the lower end of the jaw; and generally channel-shaped floating pedestal liners made from tough, wear-resistant plastic mounted on each of the pedestal legs with the bight of the channels facing the journal box and interposed as bearing surfaces between the journal box and the pedestal legs and with the sides of the channels extending over a portion of the side faces of the pedestal legs;

the improvement comprising stops mounted on the upper portion of the pedestal legs immediately adjacent the upper end of the pedestal liners when in their lowest position whereby the pedestal liners are free to move in a horizontal plane within the free space between the journal box and the facing pedestal leg, but are restrained from moving upwardly on the pedestal leg.

2. A pedestal liner according to claim 1 wherein the pedestal liners are supported on, and the lower extent of their vertical movement is restricted by, the pedestal tie bar.

3. A pedestal liner according to claim 1 wherein the tough plastic is at least one of nylon, polyester, polyacetal, polyolefin and polyimide.

* * * * *